US008277091B2

(12) United States Patent
Vermeland et al.

(10) Patent No.: US 8,277,091 B2
(45) Date of Patent: Oct. 2, 2012

(54) ABUSE-RESISTANT LIGHT FIXTURE

(75) Inventors: Lloyd E. Vermeland, Sandwich, IL (US); Daniel P. Slabek, Chicago, IL (US)

(73) Assignee: 555 International, Inc., Chicago, IL (US)

( * ) Notice: Subject to any disclaimer, the term of this patent is extended or adjusted under 35 U.S.C. 154(b) by 435 days.

(21) Appl. No.: 12/725,270

(22) Filed: Mar. 16, 2010

(65) Prior Publication Data

US 2011/0228525 A1 Sep. 22, 2011

(51) Int. Cl.
*F21V 33/00* (2006.01)

(52) U.S. Cl. ..... 362/369; 362/633

(58) Field of Classification Search ..... 362/369, 362/362, 368, 632, 633, 634, 217.1, 217.11, 362/217.13

See application file for complete search history.

(56) References Cited

U.S. PATENT DOCUMENTS 7,128,461 B2 * 10/2006 Hwang ..... 362/632
7,364,345 B2 * 4/2008 Fang ..... 362/634
7,524,075 B2 * 4/2009 Mastin ..... 362/35

* cited by examiner

*Primary Examiner* — Laura Tso
(74) *Attorney, Agent, or Firm* — Edward J. Chalfie; Husch Blackwell LLP

(57) ABSTRACT

An abuse-resistant light fixture housing having a mounting plate with mounting brackets, a frame having an opening for a-non opaque cover, and a plurality of fasteners affixing the mounting bracket to the frame is provided. When the mounting plate and frame are assembled together the frame is suspended apart from the mounting bracket such that impacts against the frame are absorbed by the suspension elements allowing the frame and light elements to survive generally undamaged. Elements of the fixture are made so as to resist damage while providing illumination.

20 Claims, 6 Drawing Sheets

ABUSE-RESISTANT LIGHT FIXTURE

FIELD OF THE INVENTION

The present invention relates to a fixture housing for a light source, and particularly to a durable, suspension mounted light fixture that is resistant to damage caused by physical abuse, vandalism or tampering.

BACKGROUND OF THE INVENTION

It is generally well-known that furnishings used inside certain buildings, such as schools, athletic facilities and stadiums, correctional institutions, detention facilities, hospitals and universities are frequently subject to heightened wear and often times intentional or unintentional physical abuse. Despite this well-known fact, many government and business entities commonly use low-cost, bulky overhead lighting and light fixtures in connection with large-scale commercial, municipal or recreational buildings.

Unfortunately, the typically low-cost overhead lights and light fixtures that are used are often not robust enough to withstand the physical abuse to which they are subjected. The result is that these light fixtures are regularly and repeatedly damaged or destroyed needing to be repaired or replaced. Repeatedly repairing or replacing light fixtures is costly and time consuming, and is disruptive to the use of the space in the location of the damaged fixture. Fixtures vulnerable to damage from physical impact can also be a danger to individuals that happen to be in close proximity at the time the damage takes place. Such persons can be harmed by broken glass or metal from the fixture, and, in the case of fluorescent lighting, can also be exposed to toxic particles that become airborne when fluorescent tubes are ruptured. People near a damaged fixture also risk electrocution from exposure to wires and other electrical components.

One of the primary reasons that these types of lights are so susceptible to damage is that they use a fragile lamp or tube that is either openly exposed to the surrounding environment, or shielded only by a flimsy or unsupported cover. Another reason is that the frame of the fixture itself is rigidly affixed to the mounting surface and thus has no flexibility such that when the fixture is impacted by an object or person the force of the impact causes damage. Accordingly, when subjected to even slight forces the frame, cover or mounting elements of such fixtures can be easily damaged.

As an alternative to the ordinary light fixtures described above, light emitting diodes (LEDs) are becoming more common in home, commercial and institutional settings. Compared to traditional light sources, LEDs when used together in LED array panels have several advantages. LEDs are high in efficiency, since as will be understood by persons having skill in the art the energy used by LEDs is used to generate light generally and not on producing heat. In addition, it has been found that LEDs typically have a much longer life than traditional incandescent bulbs such that they need not be replaced as often as incandescent or fluorescent bulbs. However, LED array panels are typically very expensive and in their current state of technology are quite fragile such that there use as a replacement for ordinary fixtures in the situations described above is premature.

Accordingly, there is a need for an economical and highly durable light fixture that is resistant to damage caused by physical force, vandalism or tampering. Objects and advantages of the present invention will become apparent as the description proceeds.

SUMMARY OF THE INVENTION

In accordance with the present invention an abuse resistant light fixture housing is provided. The housing includes a mounting plate and cooperative frame wherein the mounting plate has at least one bracket with a deflectable element and at least one fastener. The frame of the housing further defines fastener mounting points adjacent to each of the at least one brackets when the frame and mounting plate are in cooperative engagement. The deflectable elements of the brackets have cooperative fastening means such that when the at least one fastener is placed in a fastener mounting point in the frame and fastened to the adjacent cooperative fastening means on the bracket, the frame is flexibly attached to the mounting plate so that when the frame is struck the brackets deflect to absorb the energy of the strike. In effect, the frame is suspended from the mounting plate in a manner that allows the frame to move in response to being struck rather than crumple.

In the preferred embodiment, the light fixture housing includes a light fixture within the frame and a separate protective abuse resistive lens. To protect the light fixture it is attached to the frame or suspended element of the invention. The light fixture and protective abuse resistive lens are spaced apart, in the preferred embodiment to create a further energy absorbent gap there between. In some embodiments the frame defines low profile angular edges to minimize areas of direct impact on the frame, allowing for glancing blows instead.

With respect to the connection between the mounting bracket and frame, fasteners are threaded to connect the frame and the brackets; the brackets include cooperative threading means to engage the fasteners. In some embodiments the fasteners and the cooperative fastening means on the brackets cooperatively snap together.

In some embodiments of the present invention the frame includes a flange and the mounting plate defines a perimeter, and the mounting plate perimeter and frame flange are adjacent one another and spaced apart when the frame and mounting plate are in operative cooperative engagement so as to form an energy absorbing gap between the frame and mounting plate. The gap permits the elements of the fixture to flex without damaging each other.

In a preferred embodiment, the frame is created of steel and the seams of the frame are welded for strength. The cover is comprised of a material selected from the group consisting of glass, reinforced glass, polycarbonate, fiberglass, plastic and fiberglass reinforced plastic.

According to additional embodiments of the present invention, the fixture includes a light source, such as for example a light emitting diode (LED). The light source is arranged in such a way as to provide light through the non-opaque cover of the fixture so as to illuminate areas near the fixture. In one embodiment, the light source has a substantially planar configuration that covers a substantial portion of the adjacent cover. The cover and light source are secured within the fixture by a retainer plate and a plurality of fasteners around the aperture in the frame.

It is a benefit of the present invention to provide a highly-durable light fixture that is capable of withstanding harsh treatment or physical abuse caused by individuals in close proximity. This benefit is in part achieved by the compact design and durable suspension mounting arrangement between the frame and the back plate. According to this arrangement, the frame of the fixture is mounted indirectly to the back mounting plate by angled mounting brackets, as opposed to being directly affixed to a particular mounting surface. This arrangement enables the frame of the fixture to move slightly in order to absorb an impact, thus making the fixture more resistant to various forces exerted upon it by deflecting upon impact to absorb energy without transmitting potentially destructive force to fragile internal lighting components.

Another benefit of the claimed invention is to provide improved illumination to areas proximate the fixture, while at the same time utilizing less energy than an equivalent high intensity lamp. In addition, the fixture has a compact design that requires minimal overhead space, and is thus highly desirable over bulky florescent fixtures in applications with limited space. An additional benefit is to provide a safe light fixture that does not contain any potentially harmful contaminants, such as for example mercury or lead, that can potentially leak into the environment.

Additional advantages of the claimed fixture include its versatility and visually appealing characteristics. The fixture can be produced in various standard or customized sizes or shapes and can be used in connection with a variety of settings including but not limited to schools, athletic facilities and stadiums, correctional institutions, universities, hotels, hospitals, factories and offices, conference or meeting rooms, or any other residential, commercial or industrial settings. In addition, the fixture can be used for decorative or commercial purposes by utilizing an artificial light source or cover with different colors or decorative designs. Such designs can include commercial signs, slogans or trademarks for advertising or marketing purposes.

Further objects, features and advantages of the present invention will be apparent from the following description and the appended claims when taken in conjunction with the accompanying drawings.

DETAILED DESCRIPTION

Figure 1:
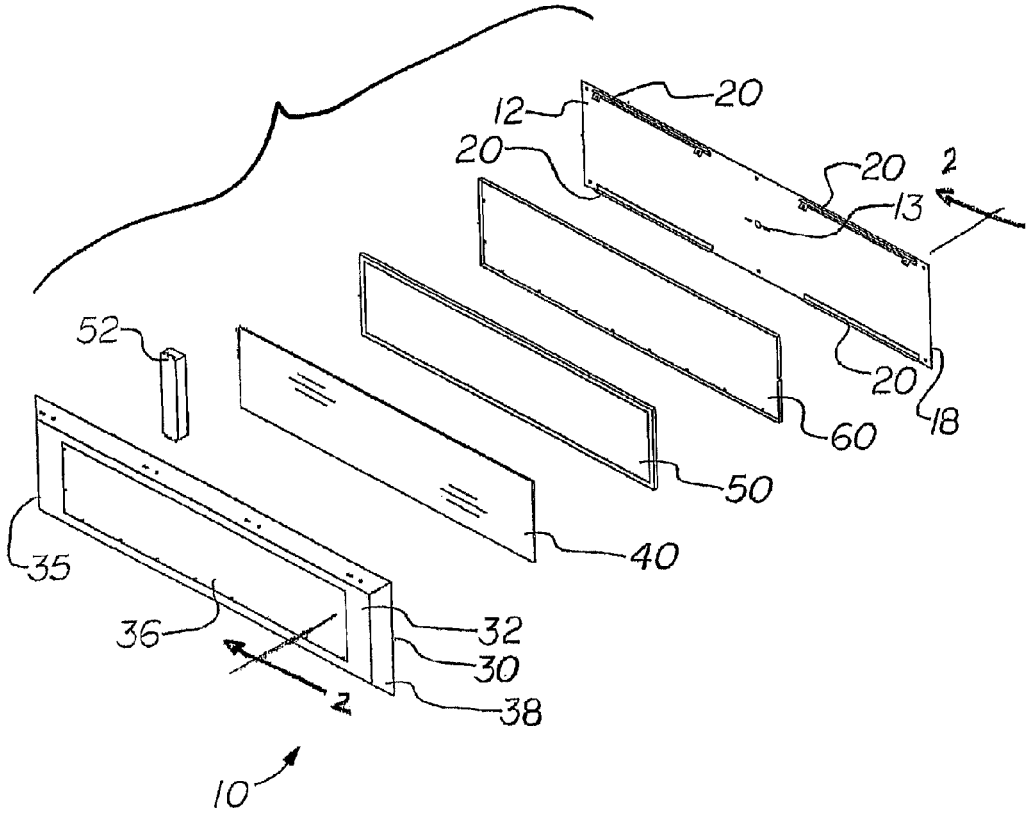
FIG. 1 is an exploded perspective view of a fixture according to one embodiment of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description") relates to a requirement of the United States Patent Office, and should not be found to limit the subject matter disclosed herein.

In this disclosure, the use of the disjunctive is intended to include the conjunctive. The use of the definite article or indefinite article is not intended to indicate cardinality. In particular, a reference to "the" object or "an" object is intended to denote also one of a possible plurality of such objects.

Figure 2:
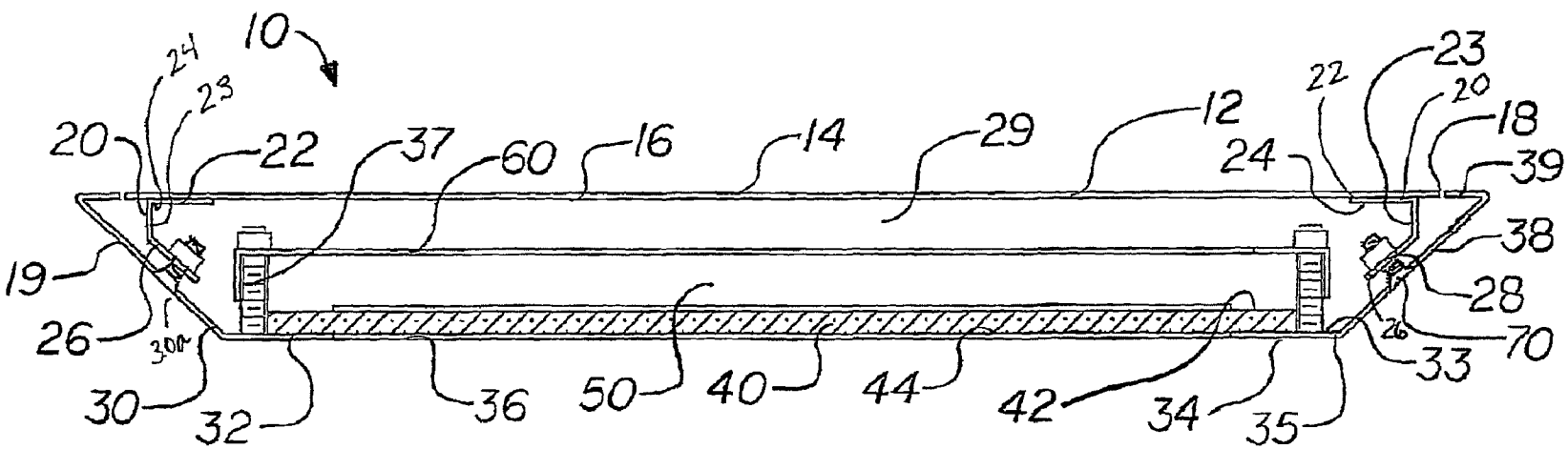
FIG. 2 is a cross sectional view of the fixture of FIG. 1 taken along the plane of line 2-2 in FIG. 1.

Referring now to the figures, and specifically to FIGS. 1-2, there is shown a light fixture 10 suitable for affixation onto a wall or ceiling. Fixture 10 comprises a mounting plate 12 and a frame 30 which when assembled together form a housing 19 having an interior cavity 29. Mounting plate 12 and frame 30, in a preferred embodiment are constructed of up to 14 gauge cold rolled steel or 304 stainless steel, however it will be understood by persons having ordinary skill in the art that steel of a gauge suitable for lamp fixtures and specifically to fixtures subjectable to violent force or any durable substantially rigid material such as, for example, other metals or alloys polycarbonates and/or other materials known to persons having ordinary skill in the art can be used without departing from the novel scope of the present invention. In other embodiments the gauge of the steel can be increased as security demands or decreased as needed. Further, among the other types of steel that can be used, without limitations, are high strength steel alloys and half hard steel. In a preferred embodiment all external seems of housing 19 are welded and ground to provide structural integrity, strength and security for the fixture.

While light fixture 10, mounting plate 12 and frame 30 are illustrated in the figures as having a generally rectangular shape it will be understood by persons having ordinary skill in the art that the device of the present invention can be made in other shapes or configurations and in a variety of sizes without departing from the novel scope of the present invention.

Figure 4:
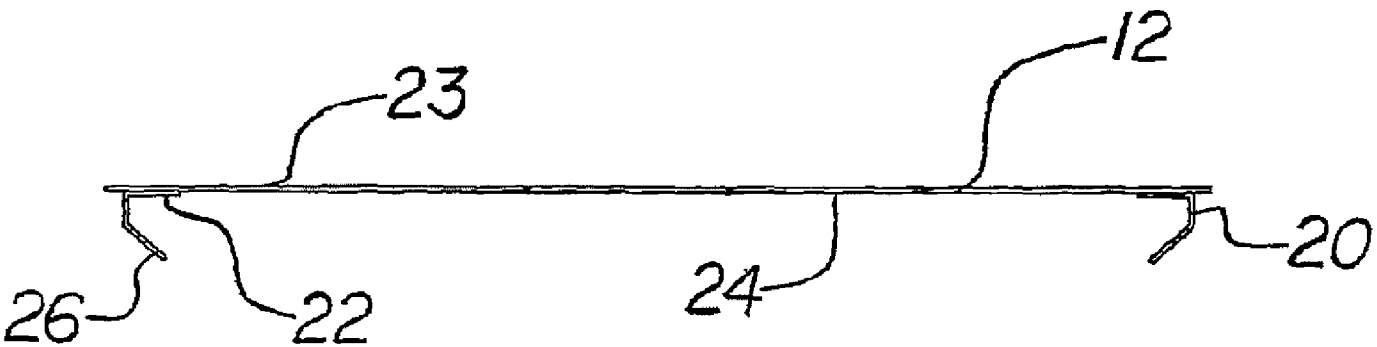
FIG. 4 is a side elevational view of the mounting plate of the device of the present invention according to one embodiment of the present invention.
Figure 5:
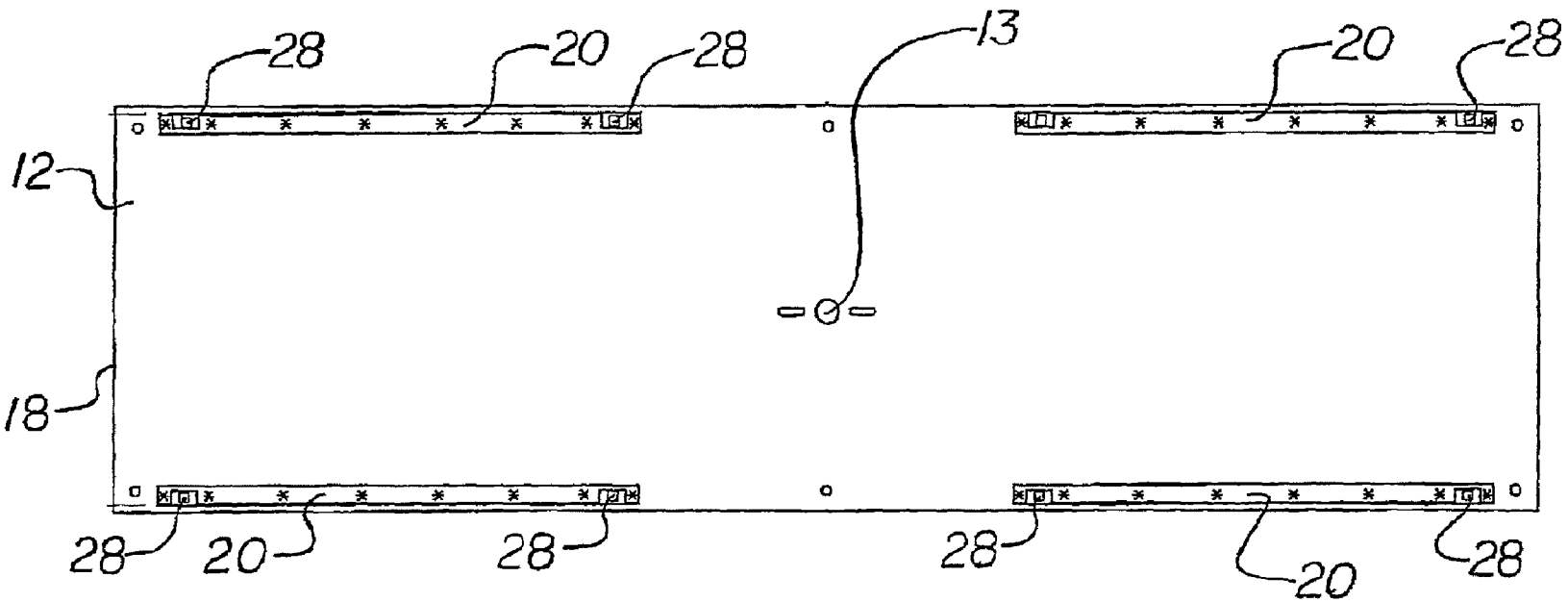
FIG. 5 is a plan view of the front side of the mounting plate of FIG. 4.

As shown in FIGS. 1, 2 and 4, the mounting plate 12 comprises a back side 14, a front side 16 and defines a perimeter 18. Back side 14 of mounting plate 12 can be made such that when installed it lies flush against the mounting surface to which it is affixed when the fixture 10 is installed. Alternatively, in other installations, when fixture 10 is installed, mounting plate 12 can hang or otherwise be suspended from a mounting surface, as desired. Referring to the figures, it will be seen that mounting plate 12 includes one or more openings 13 to allow for electrical wiring, such as a power cord, to pass from the interior cavity 29 of the fixture 10 to a power source outside the fixture 10.

Figure 1A:
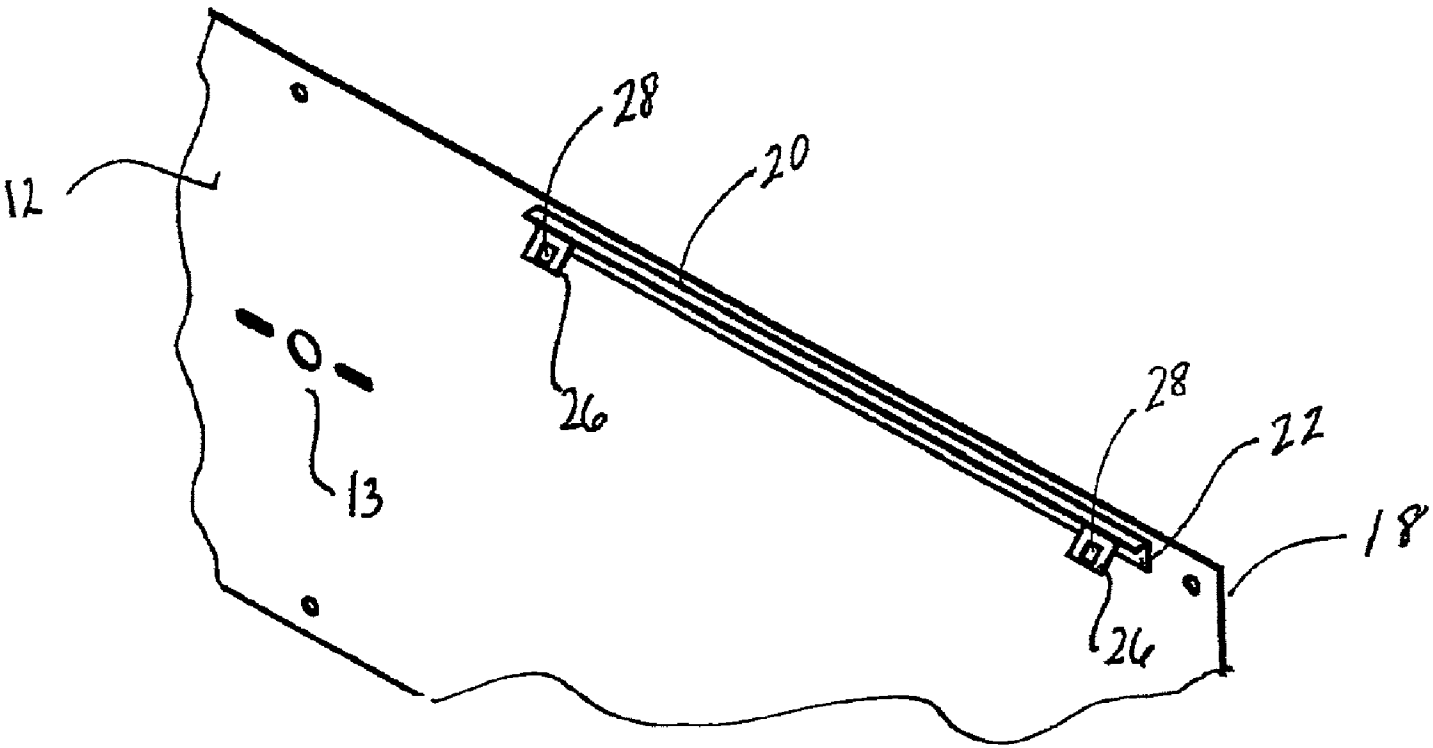
FIG. 1*a* is a perspective view, partially broken away, of a mounting bracket of the present invention.

FIGS. 1-2 and 4-5 show mounting brackets 20 affixed to the front side 16 of the mounting plate 12. As best illustrated in FIGS. 1*a* and 2, a mounting bracket 20 is a generally "L" shaped member having a base portion 22 affixed to mounting plate 12, a raised portion 23 and an arm portion 26 extending out from raised portion 23. In a preferred embodiment, arm portion 26 of each bracket 20 defines at least one aperture 28 therethrough so as to provide an anchoring point for frame 30, as will be described in greater detail below. While the figures illustrate multiple mounting brackets 20 having a particular shape and configuration, persons having ordinary skill in the art will understand that fixture 10 can comprise a single mounting bracket 20 or any number of mounting brackets 20, or that mounting bracket(s) 20 can have alternative shapes, all without departing from the novel scope of the present invention.

Referring again to the figures, it will be seen that in the embodiment illustrated in FIGS. 1 and 1*a* mounting brackets 20 are illustrated as channel brackets extending lengthwise adjacent the perimeter 18 of mounting plate 12. In this embodiment, the arm portions 26, best shown in FIG. 2, of mounting brackets 20 extend from bracket 20 and define an opening 28. Housing 30 defines openings 30*a* such that when housing 30 is placed in its operative position on mounting plate 12 opening 30*a* is adjacent opening 28 such that a fastener 70 can be inserted therethrough fastening housing 30 to mounting plate 12. In a preferred embodiment, opening 28 includes means, such as a threaded nut, to lock fastener 70 thereby securing housing 30 to mounting plate 12. Accordingly, when so secured mounting brackets 20 allow frame 30 to hang suspended from the mounting plate 12 separating frame 30 from the actual mounting surface. The suspension of frame 30 from mounting brackets 20 provides elastic cushioning to the frame 30 when it is physically impacted by an object or person; that is, arm portion 26 of mounting brackets 20 will flex under stress allowing appropriate movement of frame 30 such that the frame does not absorb the energy of such an impact. In other words, when impacted by a force, the frame 30 will slightly move relative the mounting surface relieving the stress of the impact while lessening damage to housing 30. This enables the frame 30 to absorb part of the impact and makes the fixture 10 more durable.

As will be seen in the figures, frame 30, in a preferred embodiment, comprises a substantially planar base 32 having a back side 33 and a front side 34, a perimeter 35, and at least one opening 36 through which light from the fixture emerges. While the illustrative embodiments show a single centrally located opening 36 it will be understood that fixture 10 can have any number of openings of any sizes or shapes without departing from the novel scope of the present invention. In FIG. 2 base 32, of the frame 30, is shown in substantially parallel orientation with mounting plate 12; however, it will be understood that base 32 of the frame 30 can have alternate shapes or configurations without departing from the novel scope of the present invention.

Figure 3:
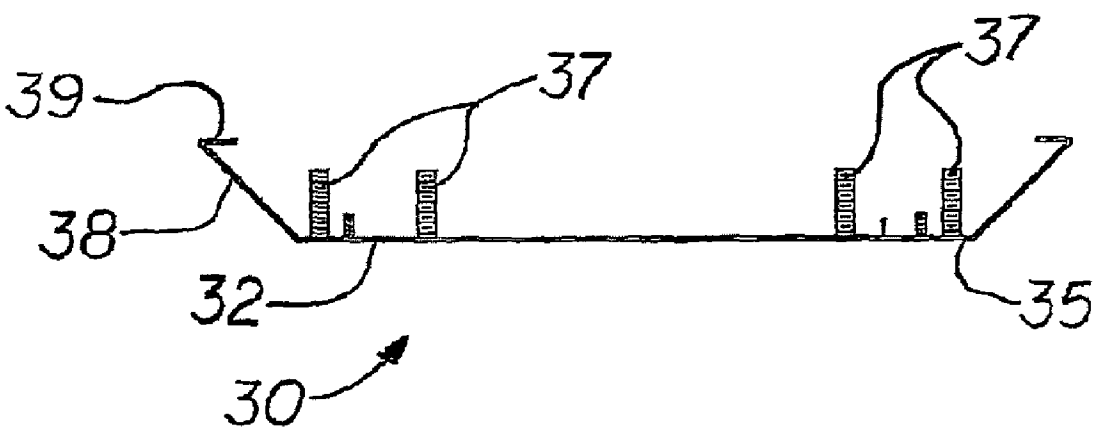
FIG. 3 is a cross sectional view of the frame of the fixture according to one embodiment of the present invention.

As shown in FIGS. 2 and 3, the frame 30 comprises a plurality of second fasteners 37 extending from back side 33 of base 32. The second fasteners 37 are positioned around the opening 36 and extend substantially perpendicularly away from base 32 of frame 30. The purpose for secondary fasteners 37 will become apparent in the further description of these elements below. It will be seen in FIGS. 2 and 3, that frame 30 has is beveled at its border 38. In the illustrative embodiment the border 38 angularly extends away from the perimeter 35 of the base 32 towards the location of mounting plate 12 when the frame 30 and mounting plate 12 are in operative cooperation. In a preferred embodiment, illustrated in FIGS. 2-3, border 38 includes an integrally formed flange 39 that is generally parallel to the surface of base 32. It will be seen that flange 39 bends towards the perimeter 18 of the mounting plate 12 and creates an expansion gap 21 between mounting plate 12 and frame 30. A discussion of the purpose for expansion gap 21 is included below. As shown in FIG. 2, when the fixture is assembled, flange 39 is substantially in the same plane as the mounting plate 12, and is thus suitable for being placed generally flush against the mounting surface when fixture 10 is installed. As noted frame 30 and mounting plate 12 form a light fixture housing 19 having an interior cavity 29.

As shown in FIGS. 1 and 2, fixture 10 has a substantially planar cover 40 suitable for spanning the one or more openings 36 located on the base 32 of frame 30. In the illustrative embodiment cover 40 can lie adjacent back side 33 of base 32, or in some embodiments cover 30 can be made integral with base 32 itself. As illustrated, cover 40 has a back side 42 and front side 44 and is made of a non-opaque medium suitable for allowing light to pass through the cover 40. As will be understood by persons having skill in the art, cover 40 can be made of either transparent or translucent materials such as, for example, glass, reinforced glass, polycarbonate, fiberglass, plastic, injection molded polycarbonate or fiberglass reinforced plastic. Cover 40 can be made in various colors, or can have various designs, logos, images or other indicia formed thereon in order to create a decorative impression or for advertising or communication purposes. In addition, while the illustrated cover, shown in FIGS. 1 and 2, has a substantially flat rectangular orientation, it will be understood that the fixture 10 can include a cover 40 having alternative shapes, sizes or configurations without departing from the novel scope of the invention. It will be understood that cover 40 can be made to accommodate whatever shape light fixture housing 30 takes without departing from the novel scope of the present invention.

As shown most particularly in FIGS. 1 and 2, fixture 10 has a light source 50 disposed within interior cavity 29 of housing 19. Light source 50 will be of a type suitable to emit light through cover 40 so as to provide illumination to areas proximate fixture 10. It will be understood by persons having ordinary skill in the art that any type of light emitting device can be used to provide the lighting element of the present invention, light source 50 can, for example, be a fluorescent type fixture, an incandescent type fixture or an array of light emitting diodes (LEDs). With respect to LEDs, it is generally understood that such light elements have advantages over incandescent and fluorescent light fixtures. These advantages include: better energy efficiency; improved directional output, and enhanced damage-resistance. Persons having ordinary skill in the art will understand that the fixture 10 can feature other types of light sources 50, besides, or in addition to, a LED device. In the illustrative embodiment the light source 50 has a substantially planar orientation and is positioned adjacent the back side 42 of the cover 40. It will be understood that light source 50 can be made in various colors, sizes or shapes to suit any application. It will be understood that elements necessary to the workings of an electrical lamp, such as an electrical ballast 52 will be operatively connected to the light source 50 in a manner understood by persons having ordinary skill in the art. Electrical elements, such as ballast 52, can be housed within the interior cavity 29 of the fixture 10, or in alternative locations proximate the fixture 10, all without departing from the novel scope of the present invention.

It will be seen that fixture 10, shown in FIGS. 1 and 2, additionally has a retainer plate 60 disposed within the interior cavity 29 of the housing 19 and adjacent the light source 50. As shown in FIG. 2, the retainer plate 40 can be fastened to the frame 30 by the second fasteners 37, noted above, extending from the back side 33 of base 32 of frame 30. The retainer plate 60 and second fasteners 37 are suitable for securing the light source 50 in place within the interior cavity 29 and can also be suitable for securing the cover 40 within the fixture.

As seen most particularly in FIG. 2, a plurality of fasteners 70 affixing frame 30, at or about border 38, to the one or more mounting brackets 20, described above. In the present embodiment fasteners 37 extend through both the border 38 of the frame 30 and the aperture 28 in the arm 26 of the mounting bracket 20. Fasteners 70 can be, for example, a nut or screw; bracket 20 can be fitted with an appropriate cooperative threading means, such as a bolt, to allow fastener 70 to be there attached. It will be understood that fastening, using clips or other means that will provide a secure connection between frame 30 and mounting plate 12, known to persons having skill in the art can be utilized without departing from the novel scope of the present invention.

The present disclosure includes that which is contained in the appended claims, as well as that of the forgoing description. Although, this invention has been described in its preferred form with a certain degree of particularity, it is understood that the present disclosure of the preferred form has been made only by way of example, and that numerous changes in the details of the elements, compositions and the combination of individual ingredients may be resorted to without departing from the spirit or scope of the invention.

What is claimed is:

1. An abuse resistant light fixture housing, comprising:

a mounting plate and cooperative frame;

the mounting plate having at least one bracket with a deflectable element;

at least one fastener;

the frame defining fastener mounting points adjacent to each of the at least one brackets when the frame and mounting plate are in cooperative engagement; and the deflectable elements of the brackets having cooperative fastening means such that when the at least one fastener is placed in a fastener mounting point in the frame and fastened to the adjacent cooperative fastening means on the bracket, the frame is flexibly attached to the mounting plate so that when the frame is struck the brackets deflect to absorb the energy of the strike.

2. The abuse resistant light fixture housing of claim 1, including a light fixture within the frame and a separate protective abuse resistive lens.

3. The abuse resistant light fixture of claim 2, wherein the light fixture is attached to the frame.

4. The abuse resistant light fixture housing of claim 2, wherein the light fixture and protective abuse resistive lens are spaced apart to create an energy absorbent gap there between.

5. The abuse resistant light fixture housing of claim 1, wherein the frame defines low profile angular edges to minimize areas of direct impact on the frame.

6. The abuse resistant light fixture housing of claim 1, wherein the fasteners are threaded and the brackets include cooperative threading means to engage the threaded fasteners.

7. The abuse resistant light fixture housing of claim 1, wherein the fasteners and the cooperative fastening means on the brackets cooperatively snap together.

8. The abuse resistant light fixture housing of claim 1, wherein the frame includes a flange and the mounting plate defines a perimeter, and the mounting plate perimeter and frame flange are adjacent one another and spaced apart when the frame and mounting plate are in operative cooperative engagement so as to form an energy absorbing gap between the frame and mounting plate.

9. The abuse resistant light fixture housing of claim 1, wherein the base of the frame has a substantially planar configuration that is substantially parallel to the mounting plate, the back side of the base of the frame having a plurality of fasteners positioned around the at least one centrally located opening and extending generally perpendicularly from the base of the frame.

10. The abuse resistant light fixture housing of claim 1, wherein the border of the frame has an integrally formed flange at an end opposite the base of the frame, the flange bending at an angle with respect to the border such that the flange is in substantially the same plane as the mounting plate, the flange defining an inner frame flange perimeter.

11. The abuse resistant light fixture housing of claim 3, wherein the inner frame flange perimeter and the base plate perimeter are spaced apart from each other to define an energy absorption gap therebetween.

12. The abuse resistant light fixture housing of claim 1, wherein the at least one mounting bracket is a channel bracket, the base of the mounting bracket having a back side and a front side, the back side of the base of the mounting bracket being flush against the front side of the mounting plate.

13. The abuse resistant light fixture housing of claim 9, further comprising a light source adjacent the back side of the at least one cover and arranged to emit light through the at least one cover.

14. The abuse resistant light fixture housing of claim 13, further comprising a retainer plate adjacent the light source, the retainer plate fastened to the frame by second fasteners, the retainer plate and the second fasteners securing the light source and at least one cover inside an interior cavity formed by the frame and the back plate.

15. The abuse resistant light fixture housing of claim 14, wherein the light source has a substantially planar orientation.

16. The abuse resistant light fixture housing of claim 8, wherein the light source is a light emitting diode (LED) array panel or a fluorescent tube panel or an incandescent bulb.

17. The abuse resistant light fixture housing of claim 1, wherein the frame is created of steel and the seams of the frame are welded for strength.

18. An abuse-resistant light fixture housing comprising:

a substantially planar mounting plate suitable for affixing the fixture to a mounting surface, the back plate having a back side, a front side and a perimeter;

at least one mounting bracket affixed to the front side of the mounting plate, the at least one mounting bracket having a base and an arm extending from the base, the arm having at least one aperture therein;

a frame having a substantially planar base with a back side, a front side, a perimeter, and at least one opening therein, the base of the frame being substantially parallel to the mounting plate, the back side of the base of the frame having a plurality of second fasteners positioned around the at least one opening and extending substantially perpendicular from the base of the frame, the frame further having a beveled border around the perimeter of the base, the border angularly extending away from the perimeter of the base of the frame towards the perimeter of the mounting plate;

at least one substantially planar cover spanning the at least one opening of the base, the at least one cover having a back and a front side and comprised of a non-opaque medium suitable for allowing light to pass through;

a light source adjacent the back side of the at least one cover and arranged to emit light through the at least one cover, the light source having a substantially planar orientation;

a retainer plate adjacent the light source, the retainer plate fastened to the frame by the second fasteners, the retainer plate and second fasteners securing the light source and cover inside an interior cavity formed by the frame and the back plate; and a plurality of first fasteners affixing the border of the frame to the at least one mounting bracket, the plurality of first fasteners extending through the border of the frame and the aperture in the arm of the at least one mounting bracket such that the frame is flexibly attached to the mounting plate.

19. The fixture of claim 18, wherein the at least one cover is comprised of a material selected from the group consisting of glass, reinforced glass, polycarbonate, fiberglass, plastic and fiberglass reinforced plastic.

20. The fixture of claim 18, wherein the frame is comprised of a material selected from the group consisting of aluminum, metal, titanium, graphite, stainless steel, tempered glass and polycarbonate.

* * * * *